US005867846A

United States Patent [19]

Paredes et al.

[11] Patent Number: 5,867,846

[45] Date of Patent: Feb. 9, 1999

[54] SHOWER DOOR ASSEMBLY

[75] Inventors: Raul M. Paredes, Barrington; Frank T. Poggio, Hoffman Estates; Bruce M. Sauter, Elgin; Dana F. Buccicone, Crystal Lake, all of Ill.

[73] Assignee: Kohler Co., Kohler, Wis.

[21] Appl. No.: 803,527

[22] Filed: Feb. 20, 1997

Related U.S. Application Data

[63] Continuation-in-part of Ser. No. 424,858, Apr. 19, 1995, Pat. No. 5,634,219.

[51] Int. Cl.[6] ..... A47K 3/22

[52] U.S. Cl. ..... 4/558; 4/608; 160/378; 160/379

[58] Field of Search ..... 4/557, 558, 600, 4/607, 608, 610; 160/378, 379

[56] References Cited

U.S. PATENT DOCUMENTS

| | | | |
|---|---|---|---|
| 1,666,727 | 4/1928 | Werbe | 160/379 |
| 2,517,086 | 8/1950 | Clay | 160/378 |
| 3,025,532 | 3/1962 | Skuda | 4/608 |
| 3,054,118 | 9/1962 | Bullock | 4/607 |
| 3,188,699 | 6/1965 | Walters | 4/607 X |
| 3,293,664 | 12/1966 | Coons | 4/599 |
| 3,940,806 | 3/1976 | Mustee | 4/614 |
| 4,539,721 | 9/1985 | Moore | 4/613 |
| 4,545,083 | 10/1985 | Searson | 4/615 |
| 4,569,092 | 2/1986 | Baus | 4/596 |
| 4,598,433 | 7/1986 | Whitney | 4/607 |
| 4,606,084 | 8/1986 | Baus | 4/607 |
| 4,720,876 | 1/1988 | Tomei et al. | 4/614 |
| 4,856,126 | 8/1989 | Baus | 4/607 |
| 4,882,795 | 11/1989 | Baus | 4/607 |
| 4,896,458 | 1/1990 | McKann et al. | 49/501 |
| 4,897,889 | 2/1990 | Baus | 4/607 |
| 4,914,770 | 4/1990 | Baus | 4/612 |
| 4,953,261 | 9/1990 | Lyons | 16/354 |
| 4,989,279 | 2/1991 | Powell | 4/612 |
| 5,023,965 | 6/1991 | Reichel | 4/607 |
| 5,070,549 | 12/1991 | Campe | 4/596 |
| 5,083,330 | 1/1992 | Dusar | 4/610 |
| 5,097,543 | 3/1992 | Oille | 4/607 |
| 5,123,129 | 6/1992 | Lyons | 4/557 |
| 5,337,424 | 8/1994 | Strack et al. | 4/557 |
| 5,634,219 | 6/1997 | Paredes et al. | 4/558 |

FOREIGN PATENT DOCUMENTS

| | | | |
|---|---|---|---|
| 0118883 | 9/1984 | European Pat. Off. . | |
| 0389000 | 9/1990 | European Pat. Off. | 4/610 |
| 2502678 | 10/1982 | France . | |
| 2683441 | 5/1993 | France | 4/610 |
| 3326790 | 2/1984 | Germany | 4/607 |
| 3831521 | 3/1990 | Germany | 4/610 |
| 0292836 | 8/1991 | Germany | 4/607 |
| 2213185 | 8/1989 | United Kingdom . | |
| 2264233 | 8/1993 | United Kingdom | 4/557 |
| 2 289 302 | 11/1995 | United Kingdom . | |
| 94/18878 | 9/1994 | WIPO . | |

OTHER PUBLICATIONS

Builders Square advertisement for "Lyon's Shower Veil Tub Door", Mar. 19–21, 1995 (2 pages).

*Primary Examiner*—Robert M. Fetsuga
*Attorney, Agent, or Firm*—Merchant, Gould, Smith, Edell, Welter & Schmidt, P.A.

[57] ABSTRACT

A lightweight, low cost shower door assembly for enclosing a tub or shower enclosure having sides and a base. It includes an upper support member adapted to be positioned against opposing sides of the enclosure and a lower support member adapted to be positioned against the base of the enclosure. A door in the assembly includes a flexible rod connecting first and second frame members. The first frame member is connected to the upper and lower support members and positioned for movement about a vertical axis. The flexible rod is bowed to apply an upward force on the second frame member in order to maintain it in releasable connection with the upper support member. In use, a section of replaceable fabric or vinyl extends across the frame members in order to provide a water barrier for the door.

11 Claims, 16 Drawing Sheets

SHOWER DOOR ASSEMBLY

CROSS REFERENCE TO RELATED APPLICATION

This application is a continuation-in-part of U.S. patent application Ser. No. 08/424,858 filed Apr. 19, 1995, U.S. Pat. No. 5,634,219.

FIELD OF THE INVENTION

This invention relates to a shower door and a method for installing a shower door.

BACKGROUND OF THE INVENTION

Shower doors are typically installed with a rigid safety glass or plexiglass material. These doors are heavy and expensive due to the glass materials. The weight of the glass materials makes it more difficult and expensive to move or transport the doors. Also, these doors usually require professional installation, since they are intended to be permanently mounted to a shower enclosure. The required installation thus also significantly increases the overall cost of the shower door. Accordingly, a need exists for an improved shower door and, more particularly, a low-cost, lightweight alternative to existing shower doors.

SUMMARY OF THE INVENTION

This invention is a shower door assembly for enclosing a tub or shower enclosure having sides and a base. It includes an upper support member adapted to be positioned against opposing sides of the enclosure and a lower support member adapted to be positioned against the base of the enclosure. A first frame member is connected to the upper support member and the lower support member and is positioned for movement about a vertical axis. A second frame member is adapted to be releasably connected to the upper support member. A brace member connects the first and second frame members in order to form a structure for the door, and the brace member is adapted to apply an upward force on the second frame member in order to maintain a releasable connection with the upper support member. In use, a section of fabric extends across the frame members in order to provide a water barrier for the door.

This invention is also a method of installing a shower door assembly for enclosing a tub or shower enclosure having sides and a base. The method includes the following steps. An upper support member is installed and positioned against opposing sides of the enclosure, and a lower support member is installed and positioned against the base of the enclosure. A sealing member is installed against one of the sides of the enclosure. A first end of a first frame member is connected to the upper support member proximate the sealing member, and a second end of the first frame member is connected to the lower support member for movement about a vertical axis. A brace member is connected to the first frame members and a second frame member. The second frame member has a first end adapted to be releasably connected to the upper support member such that the brace member is adapted to apply an upward force on the second frame member in order to maintain the second end of the second frame member in releasable connection with the upper support member. A panel is installed, extending from the sealing member past the first frame member to the second frame member.

DETAILED DESCRIPTION

This invention provides a low cost, light weight shower door assembly. The door is easily transported and installed by the consumer. Since the door is not necessarily permanently mounted in a shower enclosure, the purchaser has the advantage of being able to remove the door when moving, for example, and reinstall it. In addition, the shower door uses a removable fabric or vinyl water barrier. This means that one can purchase the fabric or vinyl in a variety of different colors or patterns in order to match a particular bathroom or shower enclosure. The fabric or vinyl is thus easily and inexpensively replaced without having to replace the entire shower door assembly.

Figure 1:
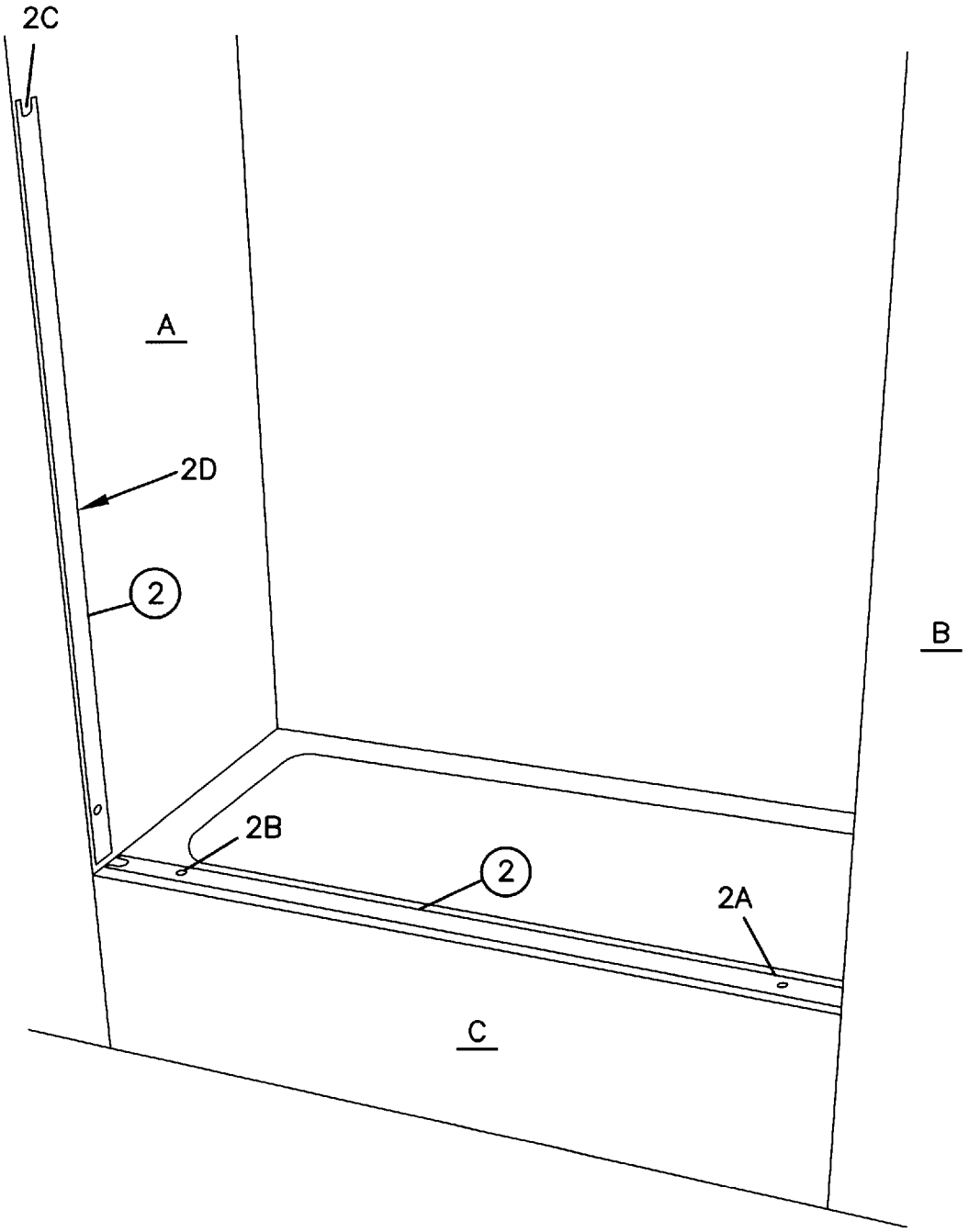
FIG. 1 is an example of a tub or shower enclosure into which is mounted a shower door assembly in accordance with the principles of the present invention.

FIG. 1 is an example of a tub or shower enclosure into which is mounted the shower door assembly. The enclosure typically includes opposing sides A and B, and a base C. The shower door assembly provides a water barrier at the opening defined by sides A and B, and base C. The shower enclosure may include a tub with base C being the tub ledge. The shower enclosure may also include simply a shower stall with the base C being at or approximately level with the floor. Other shower enclosures are possible for use with the present invention.

Figure 2:
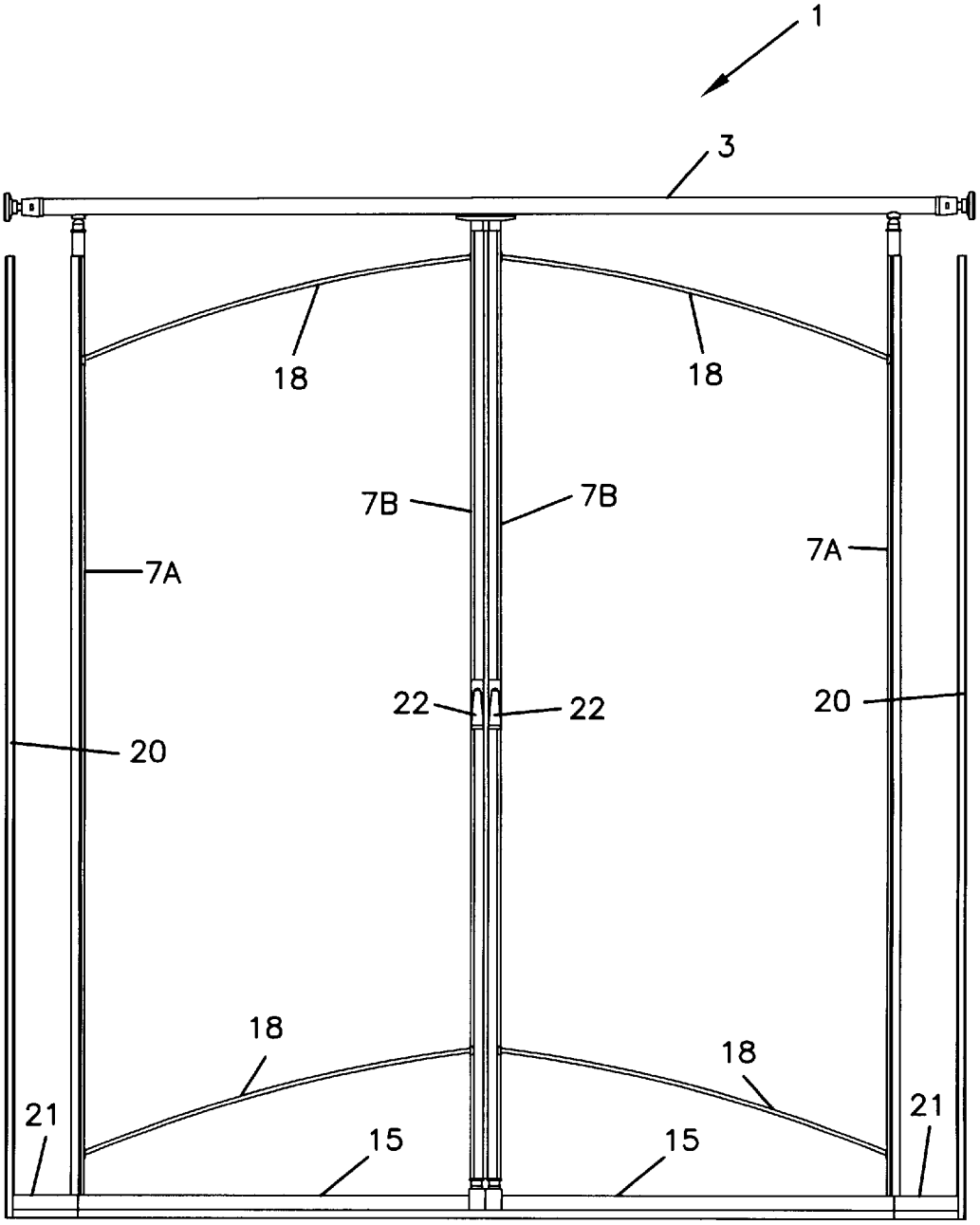
FIG. 2 is a face view of a shower door assembly in accordance with the principles of the present invention.
Figure 3:
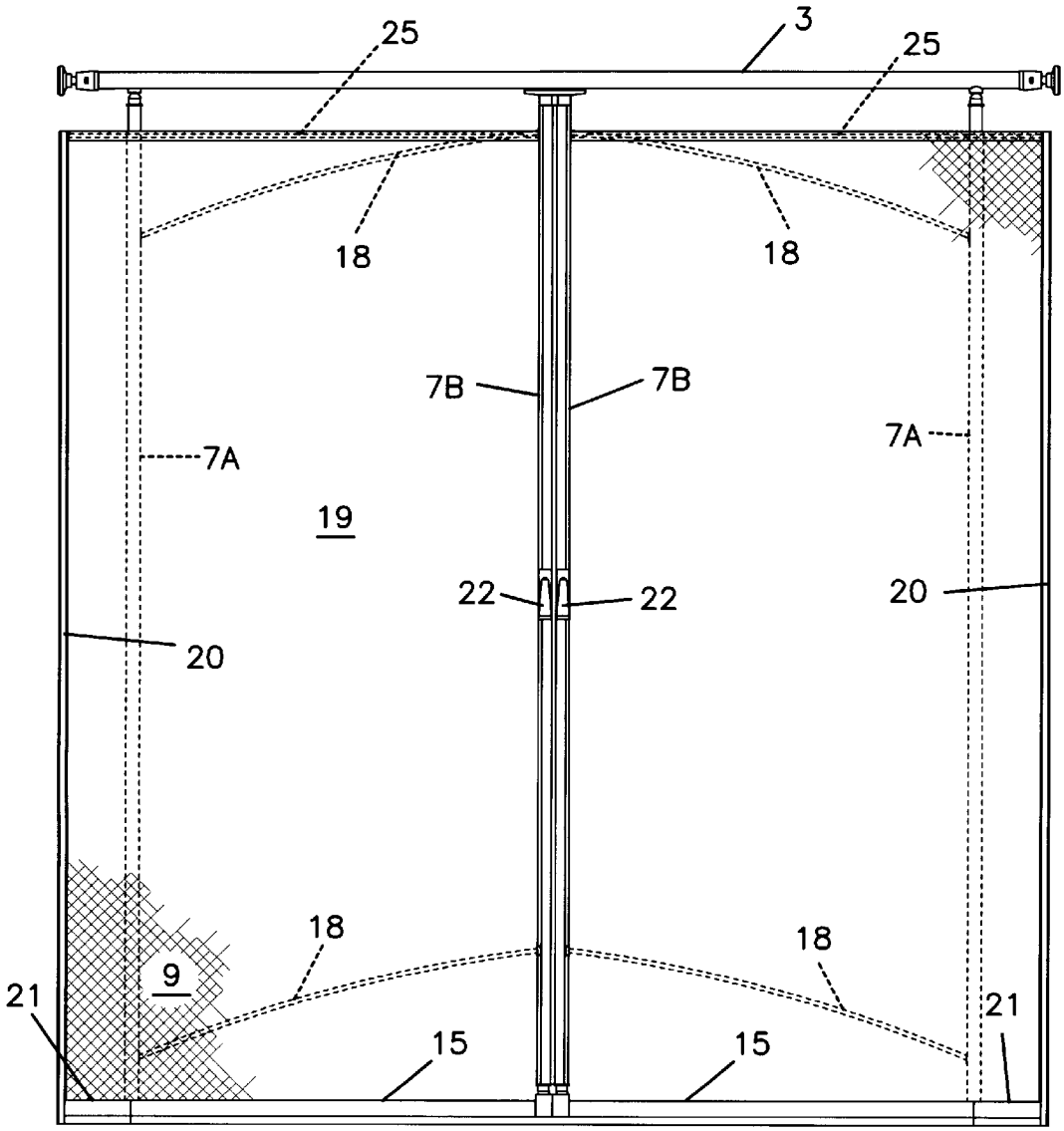
FIG. 3 is a face view of the shower door assembly with a fabric water barrier.

FIG. 2 is a face view of a shower door assembly 1 without the fabric water barrier. FIG. 3 is a face view of the fully installed shower door assembly 1 with the fabric 9. The following explains installation of the shower door assembly 1 with one door 19. The second door is assembled, installed, and operates in a similar manner as the first door 19.

Referring again to FIG. 1, there is a longitudinally extending cardboard template indicated by the numeral 2. This template has suitable transverse perforations appropriate for either a 54" or a 60" shower enclosure. Template 2 is folded along these perforations into a U-shape with the central horizontal portion positioned on the tub ledge and with the opposite vertical portions extending up shower walls A and B. Only shower wall A is shown in FIG. 7, but there would be a vertical extension of 2 oppositely disposed from that shown.

Figure 7:
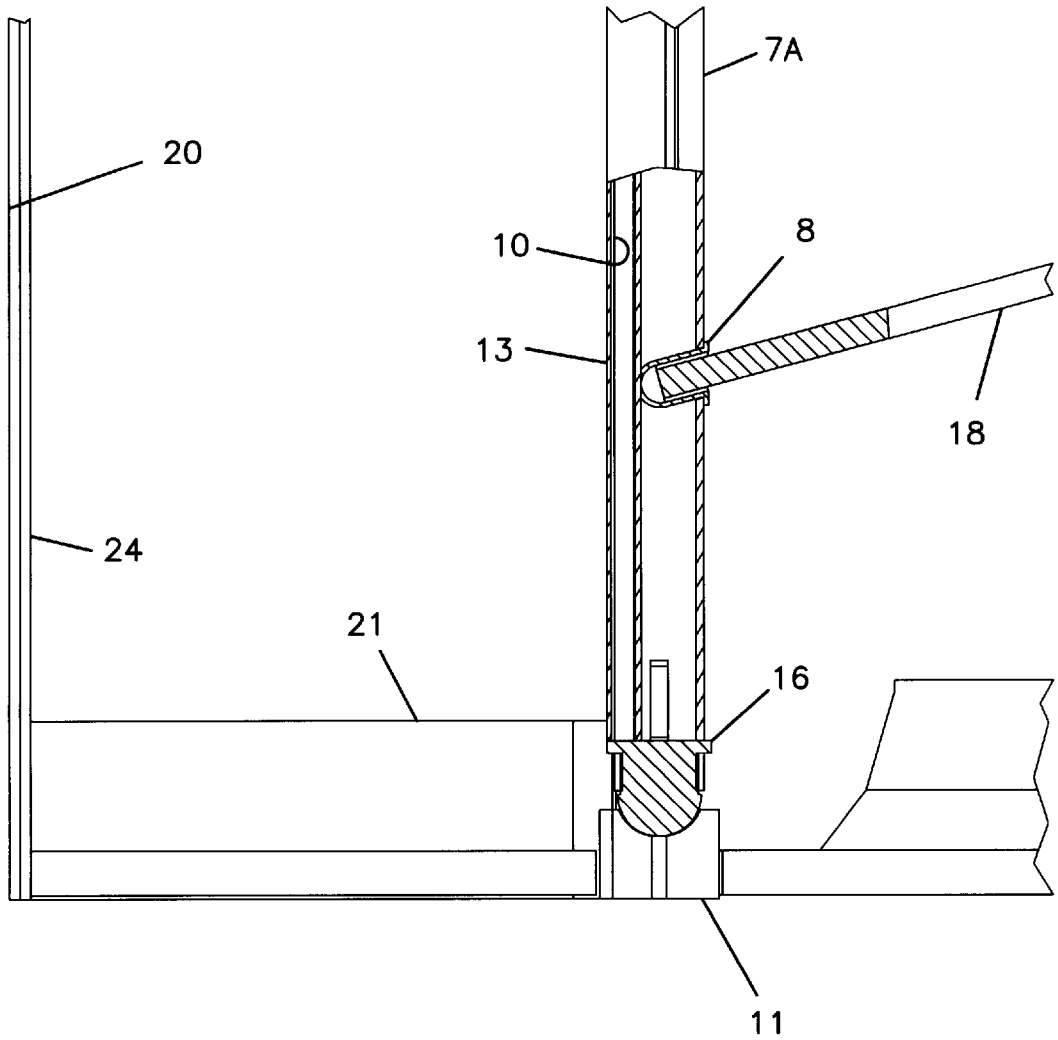
FIG. 7 is an enlarged face view of a lower left portion of the shower door assembly.
Figure 9:
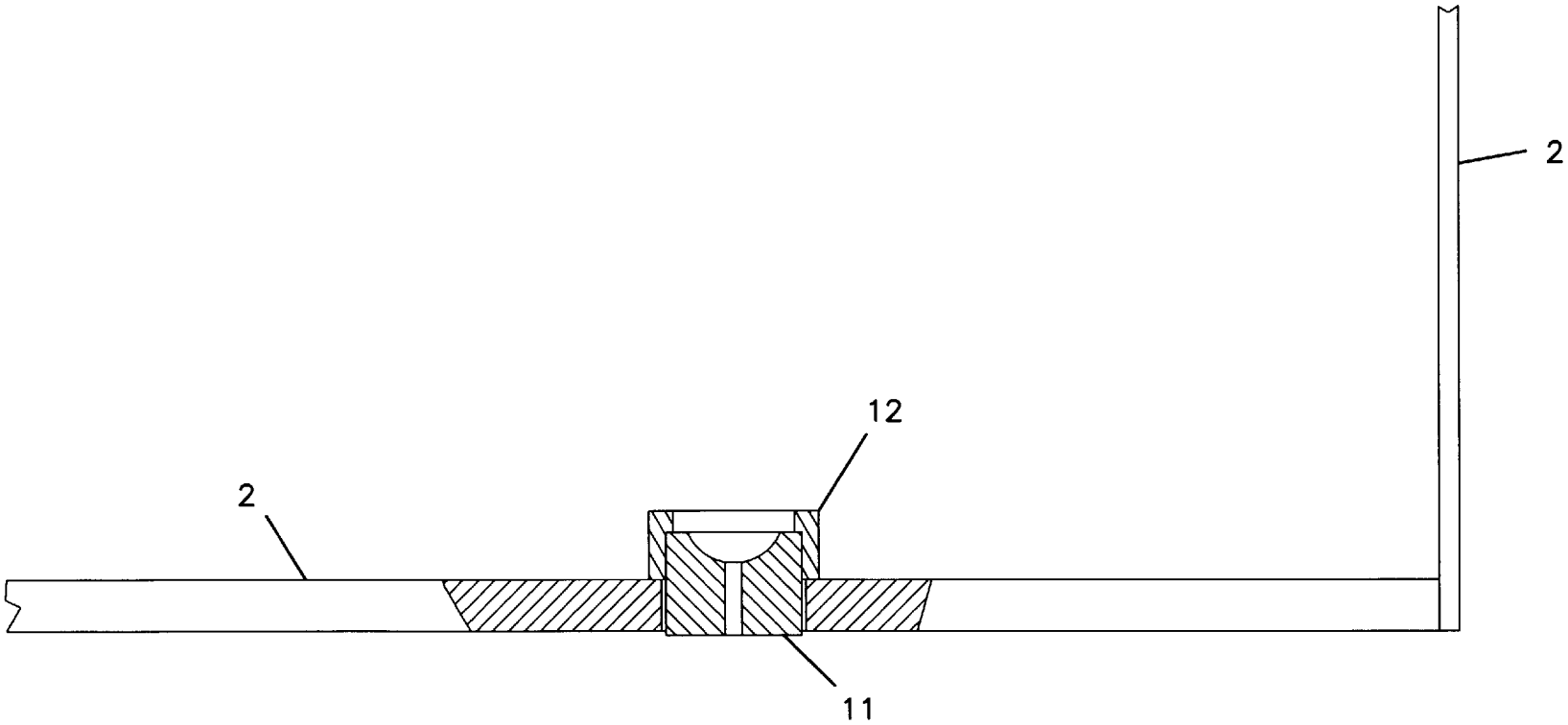
FIG. 9 is an enlarged face view of a lower right portion of the shower door assembly.

There are two generally cylindrical plastic parts, with external threads, designated by parts 11 in FIG. 2 (see FIGS. 7 and 9 for more detail of parts 11). Parts 11 have flat bottoms with suitable adhesive tape material to be used in anchoring parts 11 to the tub ledge as shown in FIGS. 2, 7 and 9. A paper backing from the flat bottom of parts 11 is removed and parts 11 are anchored to the tub ledge through the holes cut in template 2. These holes are indicated on FIG. 1 by the numerals 2A and 2B. There are two internally threaded plastic rings 12 which thread onto parts 11 to temporarily lock template 2 onto the tub ledge in the appropriate position (see FIG. 9). The upper end of the vertical extensions of template 2 each have a cut-out portion designated 2C which is used to appropriately position valance 3.

Figure 4:
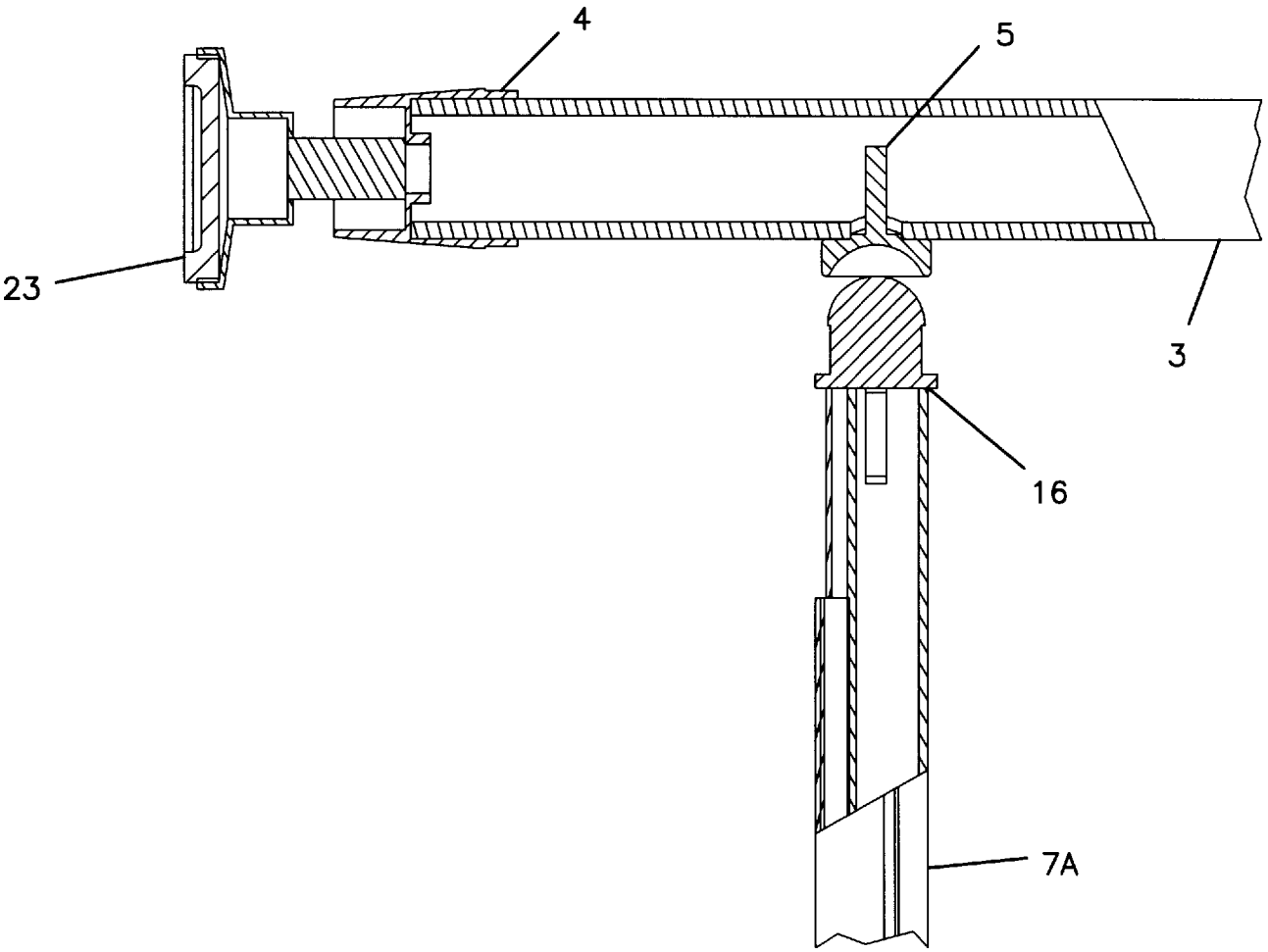
FIG. 4 is an enlarged face view of an upper left portion of the shower door assembly.
Figure 5:
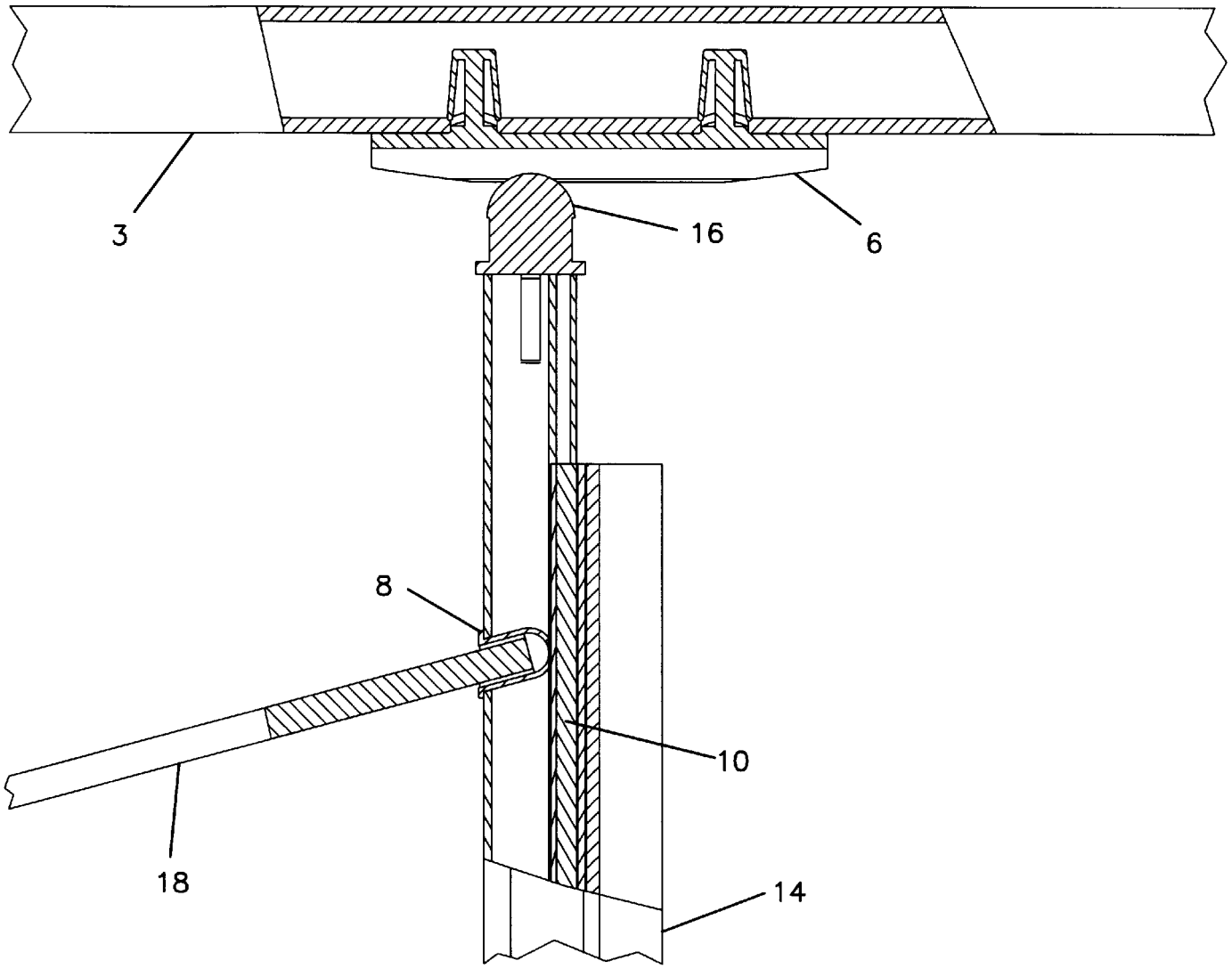
FIG. 5 is an enlarged face view of an upper middle portion of the, shower door assembly.
Figure 6:
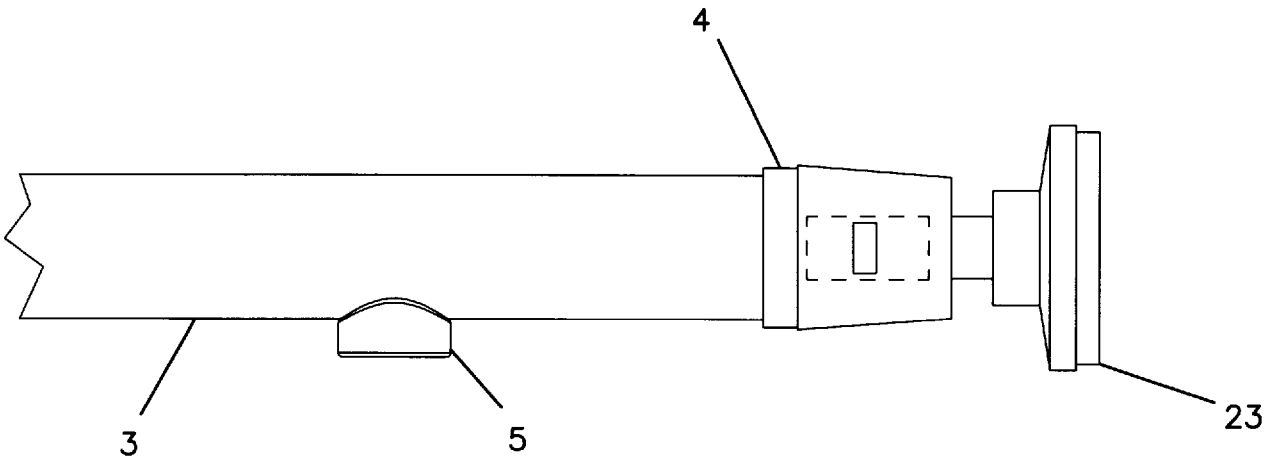
FIG. 6 is an enlarged face view of an upper right portion of the shower door assembly.

This sets the rough height of valance 3 (see FIGS. 4 and 6 for more detail of the attachment of valance 3 to sides A and B). The valance is also referred to as an upper support member and is preferably implemented with aluminum tubing. The plastic snaps of 5 and 6 are pushed into the holes of part 3 (See FIGS. 4, 5). The telescoping sections 4 are turned in order to adjust the length of part 3 such that a light, snug fit exists between rubber pucks 23 and the shower enclosure walls A and B, thus securing valance 3. Items 20 (fabric wall snap) are aligned with the vertical edge of 2 towards the inside of the shower enclosure, marked 2D on FIG. 1, paper backings are peeled away from the tape on the flat bottom of items 20, and one is attached onto enclosure wall A and the other is attached onto enclosure wall B. Template 2 is then removed by unthreading the rings 12 from each of the anchor members 11.

Referring particularly to FIGS. 7 and 9, dam members 21 should now be installed. The flat bottoms of 21 also have adhesive material and paper backing. The paper backing is removed. The right-hand end of member 21 has a hole which fits over cylindrical anchor 11 with the radius end of item 21 against the shower wall A. Referring to FIG. 2, it shows the valance 3 to be positioned against sides A and B, and also dams 21 and anchors 11 to be secured to the tub ledge or base C.

Figure 8:
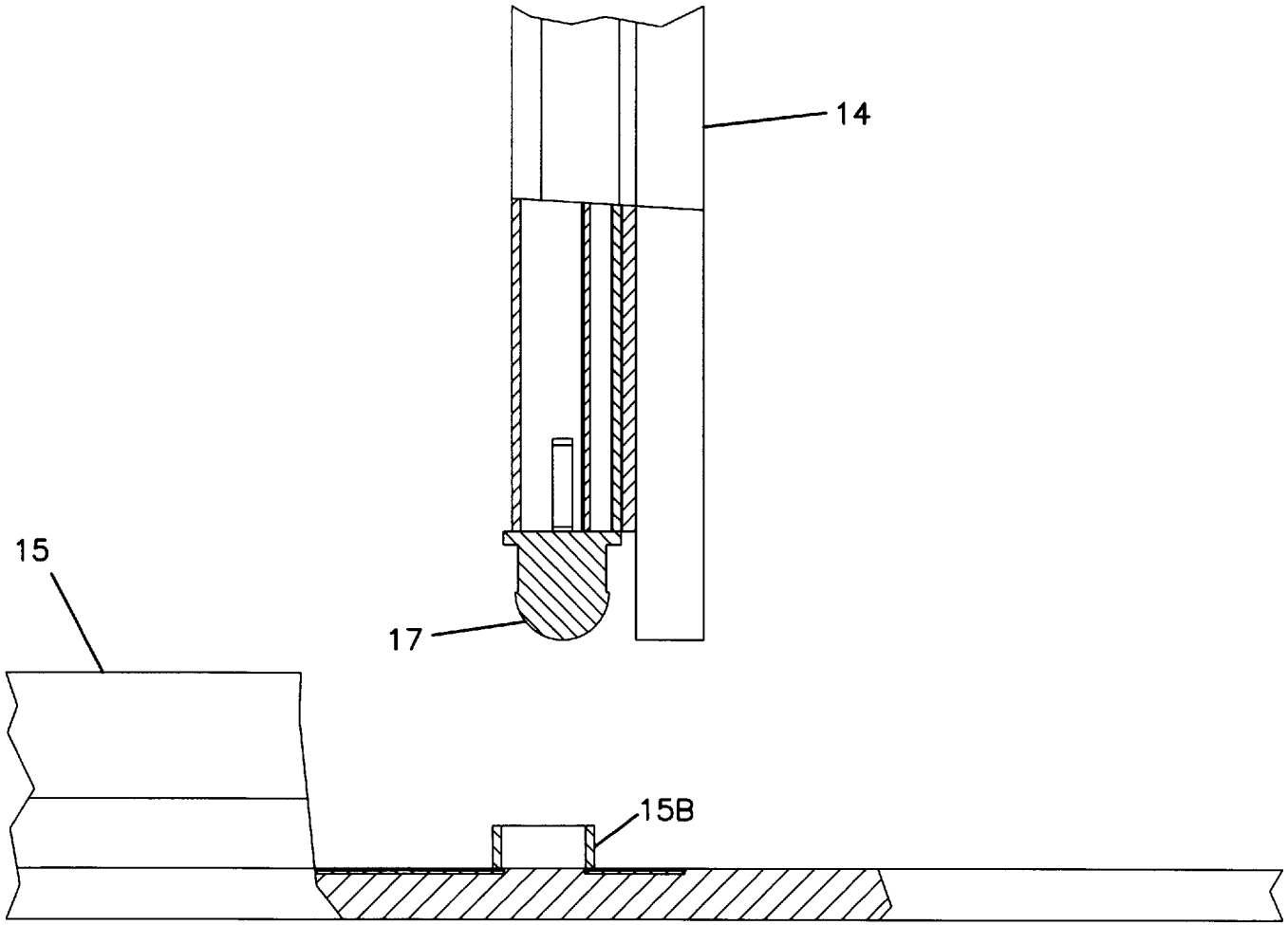
FIG. 8 is an enlarged face view of a lower middle portion of the shower door assembly.

Shower doors 19 are assembled as follows. End caps 16 and 17 are pushed into the door frame members 7A and 7B (see FIGS. 4 and 8). The frame members 7A and 7B are preferably implemented with aluminum tubing. Flexible rod mounts 8 are pushed into the holes of frame members 7A and 7B. The ends of flexible rods 18 are placed into the flexible rod mounts 8 (see FIGS. 4, 5, and 7). When installed, the flexible rods 18 are bowed slightly in order to apply an upward force on frame member 7B. The required bend in the flexible rods 18 may be accomplished by proper orientation of the mounts 8 in the frame members 7A and 7B. The flexible rods 18 are preferable bowed a sufficient amount so that frame member 7B moves about 1.5 inches in the vertical direction from the open to closed positions.

Fabric 9, shown in FIG. 3, is unrolled and positioned with its hem at what will be the upper end of the door 19. The fabric 9 is typically implemented with vinyl such as that used in conventional shower curtains. A fabric stiffening rod 25 is slid into this hem (see FIG. 3). Starting at the mating surface of 17, edge frame seal 10 is pushed into the longitudinally extending channel of door frame member 7B and the inwardly spaced frame seal 10 is pushed into the longitudinally extending channel of frame member 7A. The fabric has a flat and clean appearance. Grabbing the ends of member 15 (base or tub ledge seal), the donut-shaped ends are lightly stretched into the grooves of end caps 16 and 17 (See FIG. 8).

After the door 19 is assembled, it can be put into position. Upper end cap 16 of door frame member 7A is mated into T-shaped socket joint 5 (see FIG. 4) and the lower end cap 16 of frame member 7A is mated into part 11 or lower socket joint (see FIG. 7). The height of valance 3 may need to be adjusted slightly by turning telescoping ends 4. The door 19 is closed by pulling down on door frame member 7B and setting the hard end cap 16, which is at the upper end of door frame member 7B, into door closure detent 6 (see FIG. 5). With the door 19 closed, the longitudinal position of upper socket joint 5 is adjusted slightly by the valance telescoping ends 4. Part 13 (fabric seal guard) is pushed over door frame member 7A and part 14 (door to door seal or flange) is pushed over door frame member 7B. The bottom edge of 14 should be flush with the tub ledge. The left-hand extrusion 24 (fabric to wall seal) should be pushed into the longitudinally extending channel in wall fabric connector member 20.

When the door 19 is installed, the fabric 9 includes three seals. A first seal is formed by part 24, which is within the fabric 9, being held into part 20 (see FIG. 7). A second seal is formed by inwardly spaced frame seal 10 and fabric seal guard (see FIG. 7). A third seal is formed by edge frame seal 10 and frame member 7B (see FIG. 5). At the bottom of the shower door assembly 1, the dam members 21 and parts 15 (base or tub ledge seal) help prevent water from escaping between the bottom of the fabric 9 and the base C of the shower enclosure.

Figure 11:
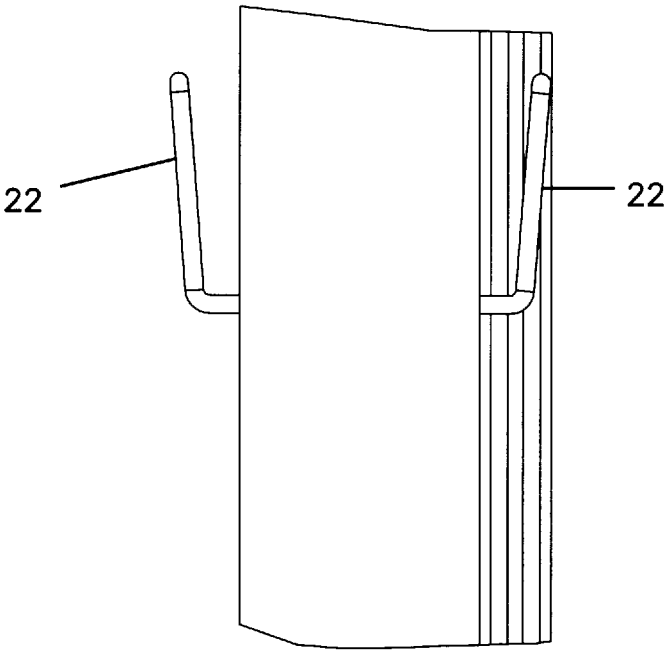
FIG. 11 is a side view of the handle, showing both a first handle on the inside and a second handle on the outside of the shower door assembly.
Figure 10:
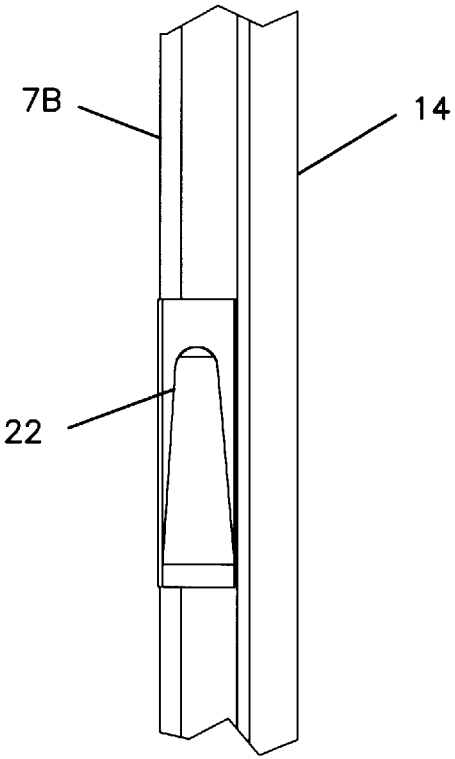
FIG. 10 is an enlarged face view of a handle for the shower door assembly.

Referring to FIGS. 10 and 11, the door 19 also includes handles 22 on both inside and outside sides of the door 19. A backing from the adhesive tape on the cylindrical surface of handle 22 is removed. The handles 22 are then attached onto the approximate midpoint of 14 on both sides.

The handles are attached to the doors with the open end facing up in order to assist a person in opening the doors. In order to open the doors, such as door 19, one grasps the handle 22 and pulls downward slightly to release the frame member 7B from the detent 6. The soft part 15B (see FIG. 8) allows one to move 7B downward when the door 19 is in the closed position. The door 19 can then be swung outward by rotation of frame member 7A about a vertical axis. The slight bend in flexible rods 18 thus allows one to easily open the door 19 by moving frame member 7B downward and also holds the door 19 in a closed position by applying an upward force on frame member 7B to hold it in contact with detent 6.

Figure 12:
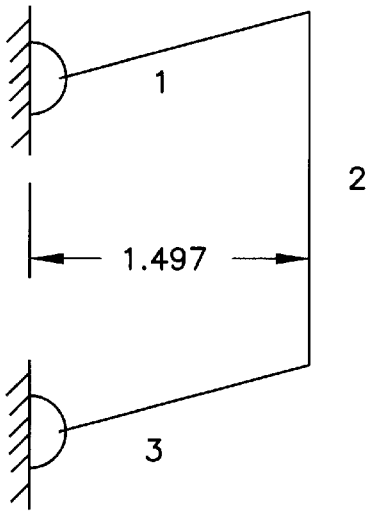
FIGS. 12–14 are linkage diagrams illustrating the use of a fabric door for the shower door assembly.
Figure 13:
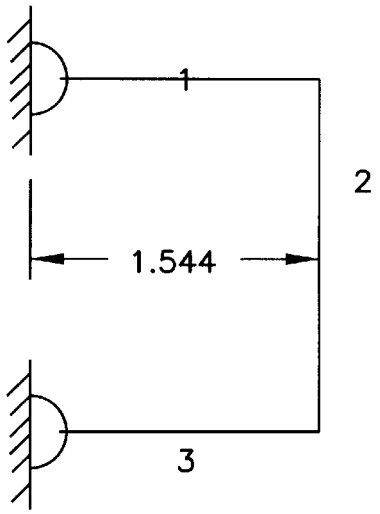
Figure 14:
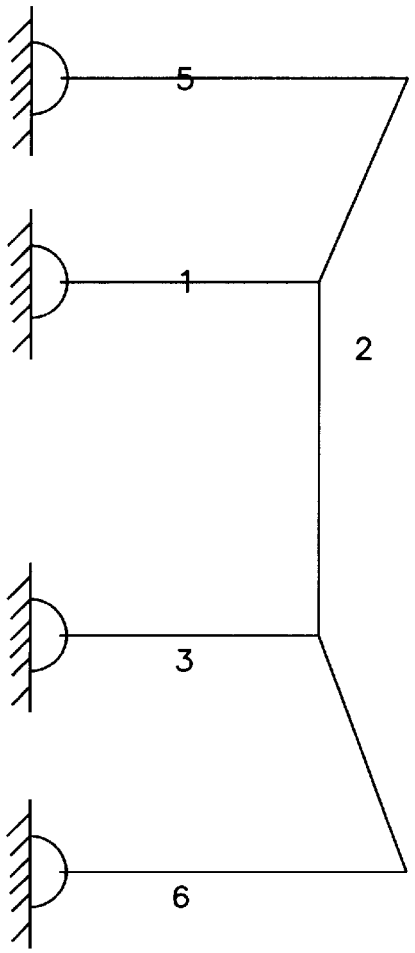

Referring to FIGS. 12–14, the following explains how the incline of flexible rods 18 aids in keeping the fabric 9 taut when the door 19 is in a closed position. As the common perpendicular distance between frame members 7A and 7B increases, the fabric becomes more taut. The shortest distance between two points is a straight line. Therefore, as flexible rods 18 unflex the distance between the endpoints of the flexible rods 18 increases.

The shower door assembly 1 can be modeled as a simple four bar linkage, as shown in FIGS. 12 and 13, ignoring the slight flexing of flexible rods 18. As demonstrated in FIGS. 12 and 13, the common perpendicular distance between frame members 7A and 7B increases. This distance increase more than makes up for the flexing of flexible rod 18 when closing the door 19 bringing 7A and 7B closer due the to the phenomenon described above. If flexible rods 18 were horizontal and bent, which they have to be in order for the door 19 to work, either the fabric 9 would have to be taut both open and closed or slack in the closed position. Having the fabric 9 taut when both open and closed effectively adds links 5 and 6, as shown in FIG. 14. This overconstrains the mechanism, i.e., it cannot move.

Figure 15:
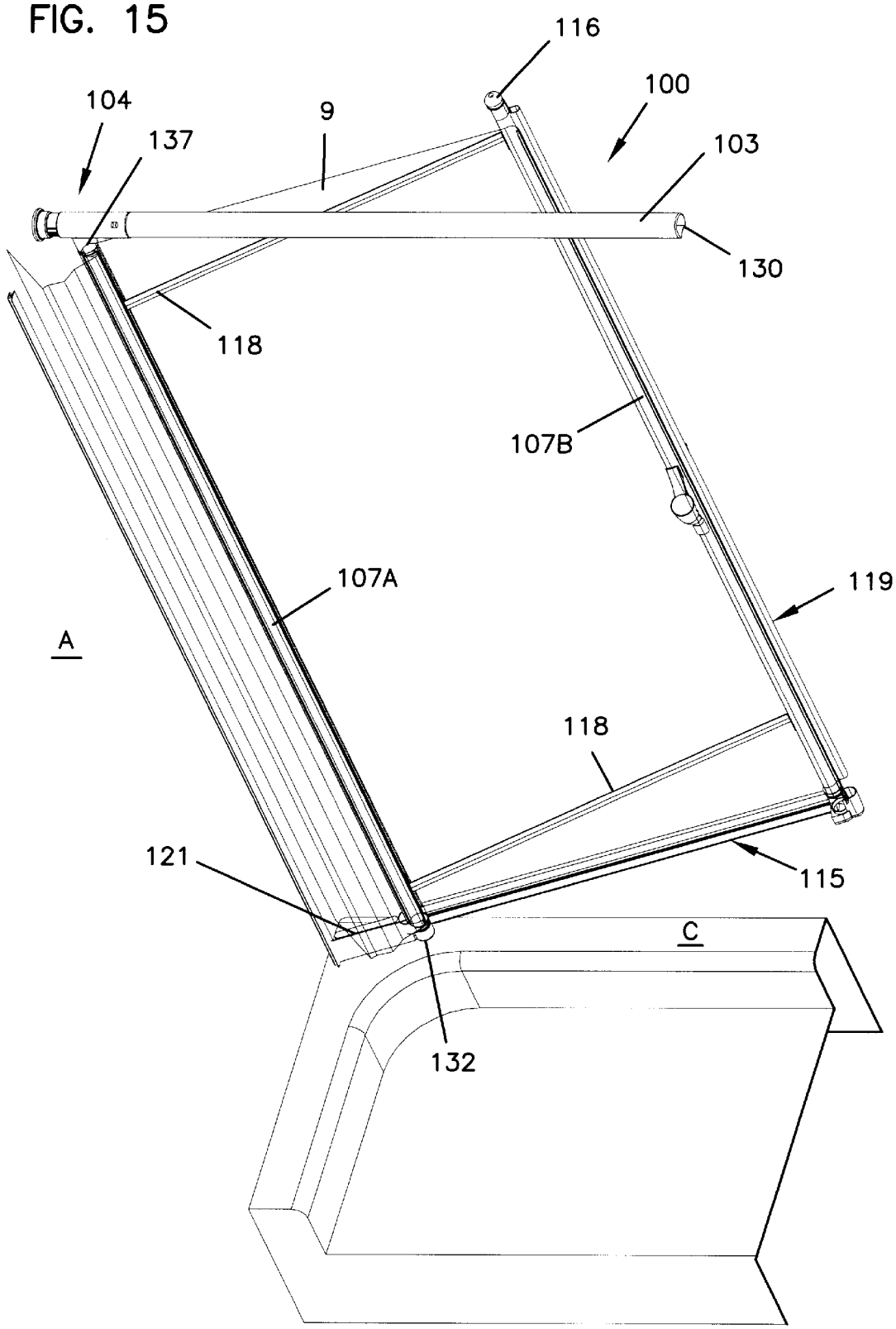
FIG. 15 is a partially assembled view of an alternative embodiment of a shower door assembly according to the principles of the present invention.
Figure 16:
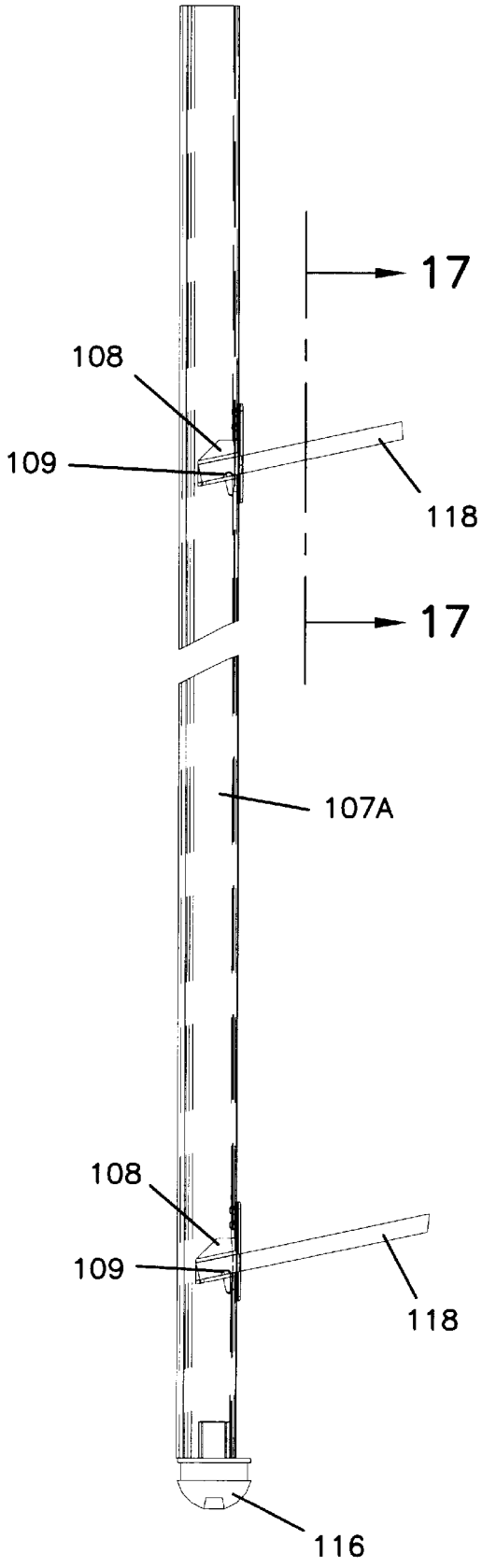
FIG. 16 is a partial cross-sectional view of a door frame member shown in FIG. 15.
Figure 17:
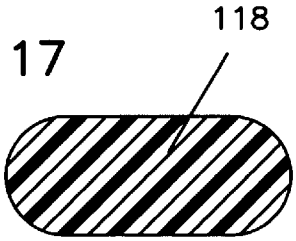
FIG. 17 is a cross-sectional view taken along lines 17—17 in FIG. 16.

Another alternate preferred embodiment consistent with the invention is shown in FIGS. 15–26. The shower door assembly 100 includes flex rod members 118 secured in the flex rod mounts 108 within the door frame members 107A, 107B with the flex rods 118 preferably having a non-circular cross-sectional profile. As shown in FIG. 17, these flex rods 118 preferably have an oval cross-sectional profile and are disposed within the door frame members 107A, 107B such that the length (or longer side) of the cross-sectional profile is disposed substantially transverse to the longitudinal axis of the door frame members. In this way, the flex rods 118 add to the rigidity of the door frame and further serve to prevent twisting of the door frame members 107A, 107B relative to each other as the flex rods 118 inherently resist bending in the horizontal plane (see FIG. 15). Furthermore, the flex rods bias the door in the vertical direction only which serves to securely retain the door in the closed position. It will be appreciated that a variety of shapes may be utilized such that the length of the cross-sectional profile is disposed substantially transverse to the longitudinal axis of the door frame member while still biasing the outer door frame member 107B in the vertical direction and reducing twisting of the door frame members relative to each other.

As shown in FIG. 16, the flex rod mounts 108 may be designed so that they snap into the door frame members and are held securely in place. This snap fit may be accomplished by numerous means and eliminates the need for fasteners or adhesives to secure the flex rod mounts 108 within the door frame members 107A, 107B. Similarly, the flex rod mounts 108 may include a retaining member 109 to secure the flex rods 118 securely in the flex rod mount 108. As shown in FIG. 16, such a retaining member 109 may be formed as a projection for engagement with the flex rod 118. In this way, the flex rod 118 is securely retained within the door frame member 107A which adds to the rigidity and stability of the shower door 119.

Figure 21:
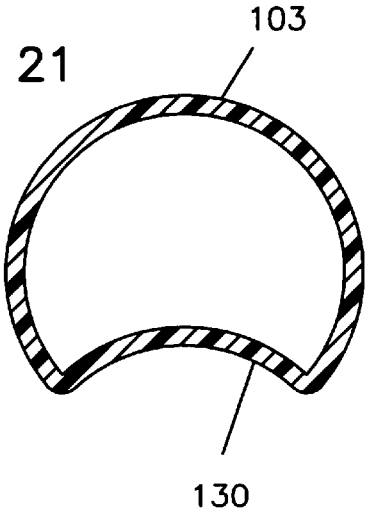
FIG. 21 is a cross-sectional view taken along lines 21—21 in FIG. 18.
Figure 22:
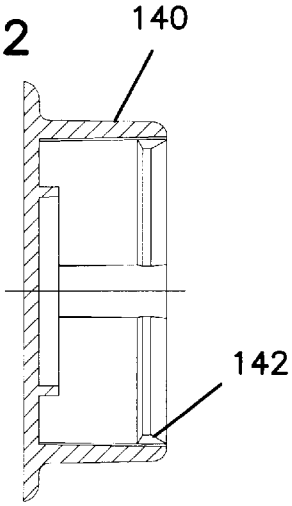
FIG. 22 is a cross-sectional view taken along lines 22—22 in FIG. 18.
Figure 18:
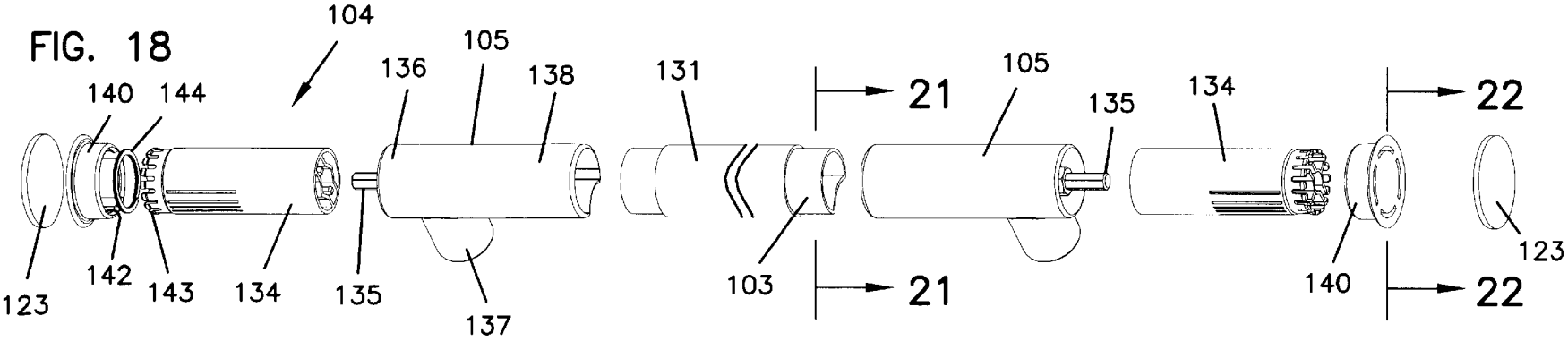
FIG. 18 is an exploded, perspective view of an alternative valance assembly according to the principles of the present invention.

In this alternate preferred embodiment, the valance 103 is formed with a groove or channel 130 which constitutes a recessed portion along its bottom edge as shown in FIG. 21. The upper end cap 116 of the door frame member 107B is disposable within this groove 130 when the door is in the closed position. To open the door, the door 119 is pulled downward such that the upper end cap 116 of the outer door frame member 107B is withdrawn from the groove 130 in the valance bottom and the door 119 may be rotated about its axis of the inner door frame member 107A to the open position (see FIG. 15). This groove 130 in the valance bottom eliminates the necessity of the detent 6 described in a previous embodiment. As shown in FIG. 18, one end 138 of a T-shaped member 105 is adapted to securely receive one end of the valance 103. In a preferred embodiment, the valance 103 may include a cover 131 which is secured around the valance 103 as shown in FIG. 18. The cover 131 is preferably formed from a colored material to enhance to the aesthetic appearance of the valance 103.

Figure 26:
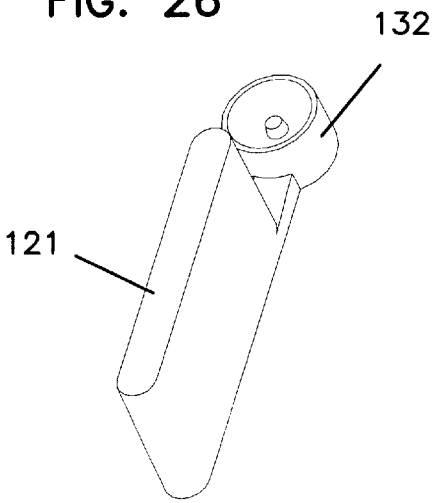
FIG. 26 is a perspective view of a water dam member shown in FIG. 15.

Referring to FIG. 26, an alternate preferred embodiment of a water dam member 121 is shown. The water dam member 121 is designed for placement adjacent the side wall A of the enclosure. The water dam member 121 includes a socket portion 132 on one end which is adapted for receiving the bottom end cap 116 of the inner door frame member 107A (see FIG. 26). In this way, the inner door frame member 107A is pivotable about its vertical axis to move the shower door between the open and closed positions.

The bottom of the water dam member 121 preferably has a suitable adhesive tape material along its length such that the water dam member 121 can be anchored to the base C of the tub or shower enclosure. The water dam member 121 is secured to the base C of the tub such that the end of the water dam member opposite the socket portion 132 is disposed adjacent the side wall A of the enclosure (see FIG. 15). The socket end 132 is located at a position along the base C so that the outer door frame member 107B will close tightly against the opposite outer door frame member extending from the opposite side wall of the enclosure. As described earlier, a template may be utilized to position the socket portion 132 of the water dam member 121 at the appropriate position for proper door alignment. It is appreciated that other methods may be utilized to locate the socket portion of the water dam member 121 at its appropriate position. It is further noted that the water dam member 121 of this embodiment combines the water dam member 21 and cylindrical anchor 11 of a previously described embodiment to provide fewer parts for ease of assembly.

As shown in FIG. 18, the valance telescoping assembly 104 connected to the upper valance 103 includes a sizing member 134 having a nut (not shown) secured in an appropriately shaped recess in one end of the sizing member 134. A T-shaped member 105 is provided so that one end 136 of the T-shaped member is disposed adjacent to this sizing member 134 and is designed to receive the sizing member therein (see FIG. 19). The T-shaped (or L-shaped) member 105 includes a bolt 135 retained within the interior of the T-shaped member which is engageable with the nut of the sizing member 134. A valance end cap 140 having a foam rubber puck 123 is connected to the end 136 of the sizing member 134 opposite the nut (see FIG. 18).

Figure 19:
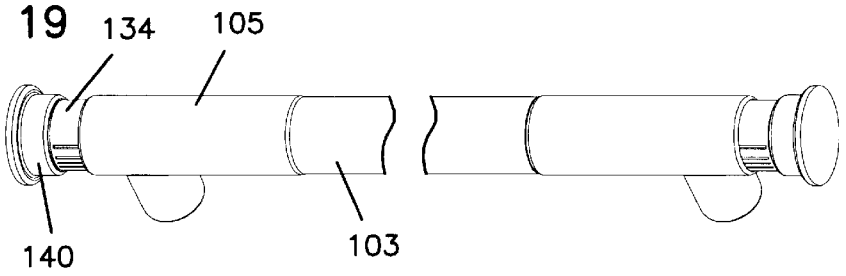
FIG. 19 is a partial, perspective view of the valance assembly shown in FIG. 18 with the telescoping portion retracted.
Figure 20:
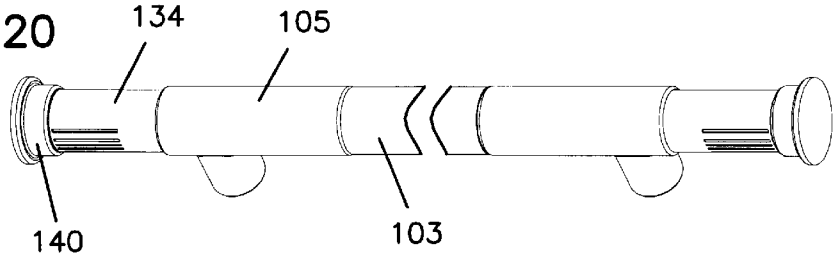
FIG. 20 is a partial, perspective view of the valance portion shown in FIG. 18 with the telescoping portion extended.

To secure the valance 103, the valance is positioned at the approximate desired height and the sizing member 134 is then rotated for movement away from the T-shaped member 105 to position the foam rubber puck 123 securely against the side A of the tub or shower wall. (See FIGS. 19, 20). To remove the valance 103, the sizing member 134 is simply rotated the opposite direction to retract the sizing member 134 toward the T-shaped member 105 and release the valance 103 from its secured position against the tub or shower wall A. As shown in FIGS. 19, 20, the telescoping assembly 104 is extendible and retractable to fit a variety of tub or shower enclosures.

As shown in FIG. 18, the telescoping assembly 104 preferably has the sizing member 134 connected to the valance end cap 140 such that the sizing member 134 is able to rotate while the valance end cap 140 remains stationary in position. In one embodiment, the sizing member 134 has a plurality of teeth or finger members 143 which are disposed within a corresponding annular groove or channel 142 within the valance end cap 140 (see FIG. 22). In this way, the teeth 143 of the sizing member 134 are able to rotate within the groove or channel 142 in the valance end cap 140. In this way, the sizing member 134 is able to rotate while the valance end cap 140 does not. This allows the valance end cap 140 with foam rubber puck 123 to engage the side wall A of the tub or shower and remain in stationary position while the sizing member 134 continues to rotate and extend outward to form a more rigid seal between the valance and the shower wall A. A spring 144 may be used between the valance end cap 140 and sizing member 134 to bias the members away from each other to form a more rigid valance assembly.

The bottom portion 137 of the T-shaped member 105 is adapted to receive the upper end of the inner door frame member 107A (see FIG. 15). In this way, the inner door frame member 107A (FIG. 16) is retained in a vertical alignment and is still permitted to rotate about its lower end cap 116 disposed in the socket portion 132 of the water dam member 121. This alternate embodiment eliminates the necessity of the upper end cap-socket 5 arrangement of the inner door frame member described in a previous embodiment.

Figure 23:
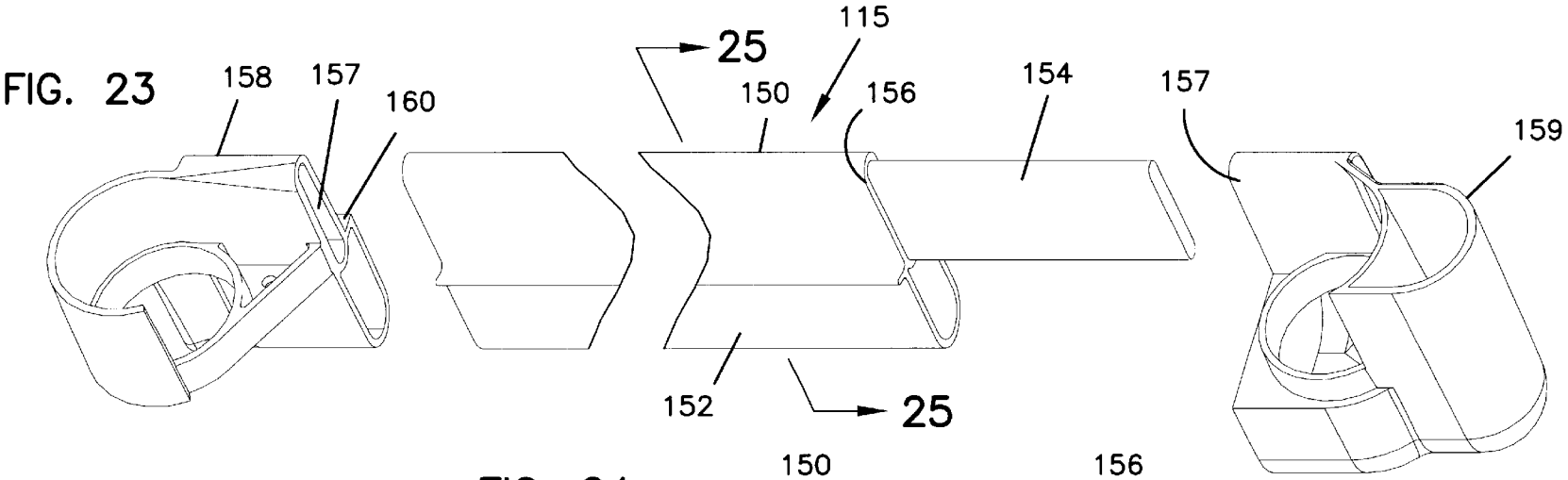
FIG. 23 is an exploded, partial perspective view of an alternative lower seal according to the principles of the present invention.

Referring to FIG. 23, a lower seal 115 is preferably provided. The lower seal 115 includes a main body portion 150 and end sleeves 158, 159 designed to receive the end caps 116 secured to the bottom of the door frame members 107A, 107B. This connects the lower seal 115 along the bottom of the door 119 so that the lower seal 115 moves in conjunction with the door 119 (see FIG. 15). The lower seal 115 preferably includes a flexible sealing member 152 which runs along the entire bottom length of the lower seal 115 (FIG. 23). The sealing member 152 is designed to engage the bottom surface C of the tub or shower enclosure to form a continuous seal when the shower door is closed. The sealing member 152 is compressible and preferably constructed of a material such as rubber so that it deforms against the bottom C of the enclosure when the door 119 is closed.

Figure 25:
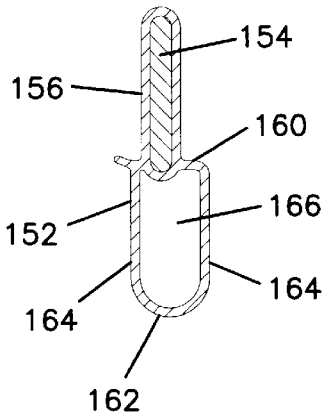
FIG. 25 is a cross-sectional view taken along lines 25—25 in FIG. 23.

The sealing member 152 preferably forms a continuous arcuate surface 162 at its lower end with upwardly extending sidewalls 164 having a void 166 therein (see FIG. 25). In this way, the arcuate surface 162 of the sealing member 152 is able to compress and form a uniform and continuous seal with the bottom C of the enclosure regardless of the positioning of the door 119 as it comes into contact with the bottom C of the enclosure. Further, the continuous arcuate surface 162 of the sealing member also provides for uniform and continuous sealing whether the door 119 is opened inward or outward with respect to the bottom C of the enclosure.

Referring to FIG. 23, the lower seal 115 also preferably has a sleeve portion 156 connected to the sealing member 152 and adapted to receive a stiffener member 154. The stiffener member 154 is preferably constructed of a rigid material such as aluminum and runs along the entire length of the lower seal 115 within the sleeve 156. The stiffener member 154 serves to strengthen the main body of the lower seal 115 so that substantially only the sealing member 152 is compressed when the door 119 is closed. This allows the door 119 to form a more rigid, continuous seal with the base C of the enclosure so that the door resists breaking its seal when bumped or jostled. Accordingly, the stiffener member 154 resists bending in the vertical plane so that sufficient pressure exists between the compressible sealing member 152 and the base C of the enclosure to form an effective seal (see FIG. 25). The combination of the stiffener member 154 positioned above the sealing member 152 allows for consistent contact and pressure along the entire length of the base C of the enclosure when the door 119 is closed.

As shown in FIG. 23, the stiffener member 154 preferably extends through the entire sleeve 156 of the main body 150 and further extends into corresponding cavities 157 in the end sleeves 158, 159. In this way, the stiffener member 154 is positioned adjacent the bottom of the door frame members 107A, 107B and adds to the rigidity and strength of the shower door assembly. This also serves to prevent the lower seal 115 from twisting relative to the door frame members 107A, 107B. In this way, when the door 119 is moved from the closed to the open position, a lower seal 115 moves in conjunction with the movement of the door frame member 107B to provide a more rigid shower door 119.

As shown in FIG. 25, the lower seal 115 preferably includes a ridge 160 that runs adjacent the connection of the sleeve 156 and sealing member 152. The ridge 160 is designed for engagement with the bottom edge of the fabric material 9 of the door. In this way, the bottom edge of the fabric material 9 of the door is disposed against the lower seal 115 which helps to direct water back into the enclosure during use to prevent water from getting outside the tub or shower enclosure.

Figure 24:
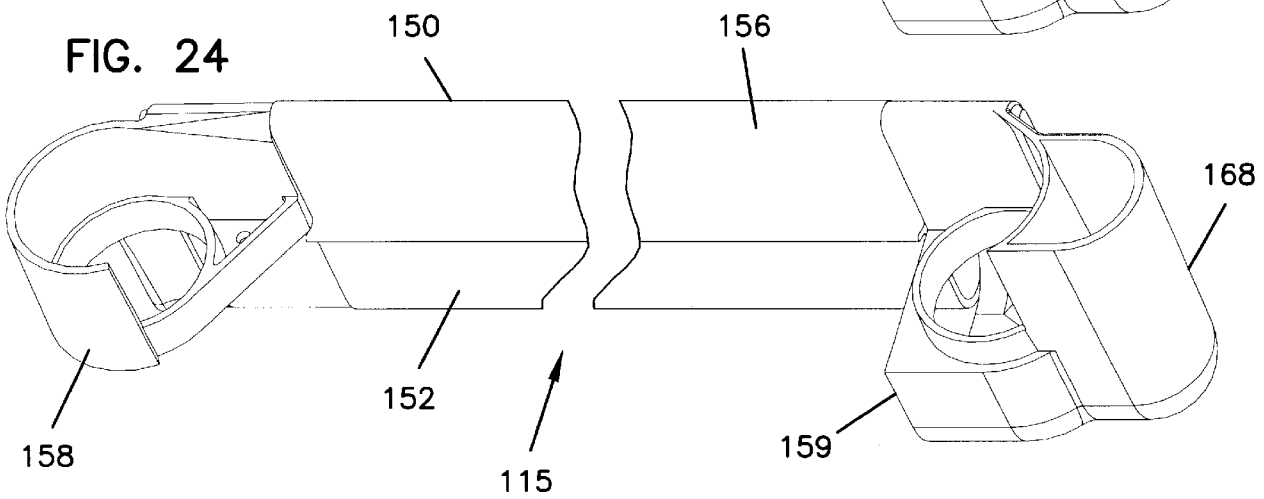
FIG. 24 is a partial, perspective view of the lower seal shown in FIG. 23.

Referring to FIG. 24, the outer end sleeve 159 of the lower seal 115 is preferably constructed of a compressible material such as rubber so that it is deformable against the bottom C of the enclosure when the door 119 is closed. Similarly, the side portion 168 of the end sleeve 159 is deformable against the corresponding end sleeve of the opposite door (not shown) so that an effective door to door seal is made when the shower doors are closed.

It is to be understood that even though numerous characteristics and advantages of various embodiments of the present invention have been set forth in the foregoing description, together with the details of the structure and function of various embodiments of the invention, this disclosure is illustrative only and changes may be made in the detail, especially in matters of shape, size, and arrangement of parts, with the principles of the present invention, to the full extent indicated by the broad general meaning of the terms in which the appended claims are expressed.

Other modifications of the invention will be apparent to those skilled in the art in view of the foregoing descriptions. These descriptions are intended to provide specific examples of embodiments which clearly disclose the present invention. Accordingly, the invention is not limited to the described embodiments or to the use of specific elements, dimensions, materials or configurations contained therein. All alternative modifications and variations of the present invention which fall within the spirit and broad scope of the appended claimed are covered.

What is claimed is:

1. A shower door assembly for enclosing a tub or shower enclosure having opposing sides and a base, comprising:

an upper support member adapted to be positioned against opposing sides of the enclosure;

a lower support member adapted to be positioned against the base of the enclosure;

a frame, comprising first and second laterally spaced frame members, the first frame member having a first end connected to the upper support member and a second end connected to the lower support member for movement about a vertical axis between an open and closed position, and a second frame member having a first end adapted to be releasably connected to the upper support member;

a panel extending between the first and second frame members;

a brace member connected between the first and second frame members, the brace member being adapted to apply an upward force on the second frame member in order to maintain the first end of the second frame member in releasable connection with the upper support member when the frame is in the closed position; and a lower seal connected to the frame, and releasably engageable with the base of the enclosure.

2. The shower door assembly of claim 1 wherein the upper support member includes a recessed portion such that the first end of the second support member is selectively disposed within the recessed portion to releasably connect the second frame member to the upper support member.

3. The shower door assembly of claim 1 wherein the upper support member is formed having a groove running along a bottom portion of the upper support member such that the first end of the second support member is selectively disposed within the groove to releasably connect the second frame member to the upper support member.

4. The shower door assembly of claim 1 wherein the brace member comprises a pair of laterally spaced flexible rods each having a first end connected to the first frame member and a second end connected to the second frame member, and each being bowed in order to apply the upward force on the second frame member, the flexible rods each having a non-circular cross-sectional profile.

5. The shower door assembly of claim 4 wherein the flexible rods are formed with a cross-sectional profile having a length and width and wherein the rods are connected to the first and second frame members with the length of the cross-sectional profile of the rods disposed transverse to the vertical axis of the frame members.

6. The shower door assembly of claim 4 wherein the flexible rods each have an oval cross-sectional profile.

7. The shower door assembly of claim 1 wherein the lower seal is secured between the second end of the first frame member and a second end of the second frame member, the lower seal including a flexible sealing member which extends along the length of the lower seal for releasable engagement to the base of the enclosure when the door frame is in the closed position, and a stiffening member which extends along a length of the sealing member such that a portion of the stiffening member is disposed at a position above the sealing member.

8. The shower door assembly of claim 7 wherein the lower seal includes a sleeve connected to the sealing member and adapted to receive the stiffening member such that a portion of the stiffener member is disposed at a position above the sealing member.

9. The shower door assembly of claim 7 wherein the sealing member includes a lower portion having a continuous arcuate surface for releasable engagement with the base of the enclosure.

10. The shower door assembly of claim 1 wherein the upper support member includes a telescoping member which is movable in a direction toward the side of the enclosure for securing the upper support member against the side of the enclosure.

11. The shower door assembly of claim 1 wherein the telescoping member includes a sizing member and an end cap connected to the sizing member wherein the sizing member rotates to move the end cap toward engagement with the side wall of the enclosure and the end cap does not rotate with the sizing member.

* * * * *